US005566737A

United States Patent [19]

Erber

[11] Patent Number: 5,566,737

[45] Date of Patent: Oct. 22, 1996

[54] LOUVERABLE ROLLER BLIND

[75] Inventor: Gunther Erber, Ebental, Austria

[73] Assignee: Andreas Erber, Ebental, Austria

[21] Appl. No.: 284,425

[22] PCT Filed: Apr. 20, 1993

[86] PCT No.: PCT/AT93/00066

§ 371 Date: Aug. 3, 1994

§ 102(e) Date: Aug. 3, 1994

[87] PCT Pub. No.: WO93/21417

PCT Pub. Date: Oct. 28, 1993

[30] Foreign Application Priority Data

Apr. 21, 1992 [AT] Austria ..... 812/92

[51] Int. Cl.[6] ..... E06B 9/08

[52] U.S. Cl. ..... 160/133; 160/201; 49/86.1

[58] Field of Search ..... 160/133, 201; 49/86.1, 74.1

[56] References Cited

U.S. PATENT DOCUMENTS 3,302,692 2/1967 Gray ..... 160/133

3,989,084 11/1976 Inamura et al. ..... 160/133 X

*Primary Examiner*—Blair Johnson

*Attorney, Agent, or Firm*—Young & Thompson

[57] ABSTRACT

A louverable roller blind has lamellar blind slats (14), similar to Venetian blind slats, hingedly linked at their upper areas to pull chain elements (21, 40) and at their lower areas to adjusting chain elements (23, 41). The blind slats (14) are further laterally guided in stationary guide profiles (31). Pins (32) that connect the adjusting chain elements (23, 41) to the blind slats (14) are spaced apart from a plane in which hinge pins (30) of the adjusting chain elements (23, 41) are located. The hinge pins (30, 32) that link the pull chain elements (21, 40) and the adjusting chain elements (23, 41), as well as swivelling pins (16) of the blind slats (14), are mutually aligned when the roller blind is not used as a Venetian blind. This alignment allows the roller blind to be rolled up without problems in a reduced space and to be used as a Venetian blind with no need for special aids.

12 Claims, 4 Drawing Sheets

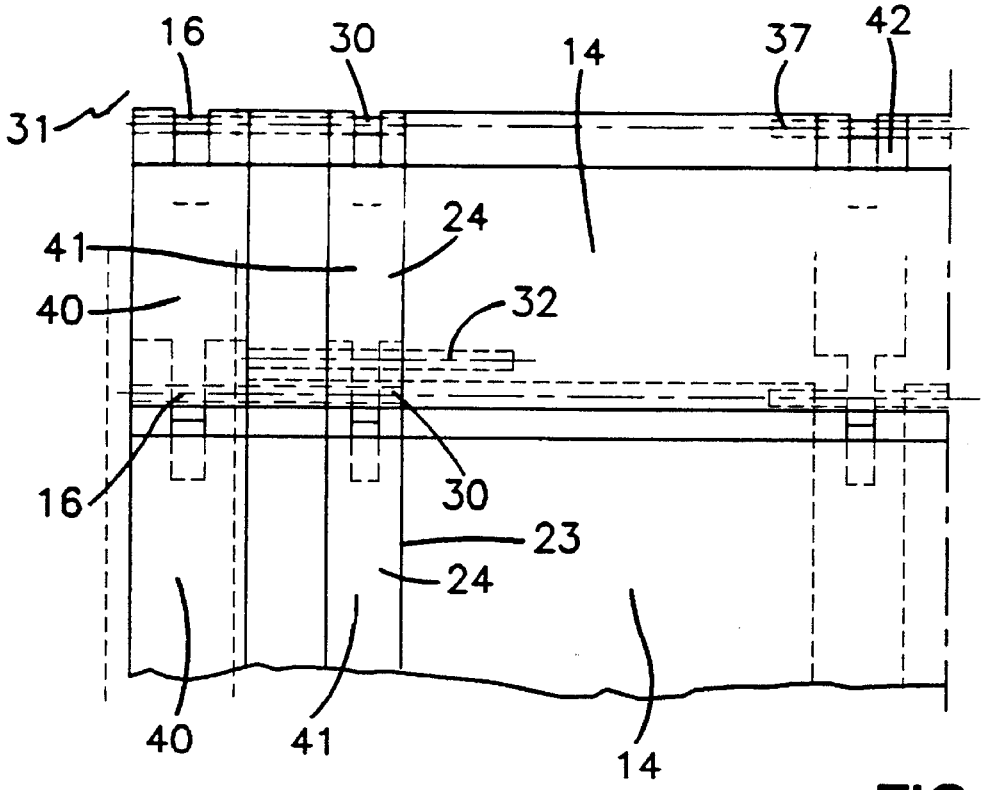
FIG. 9
FIG. 10
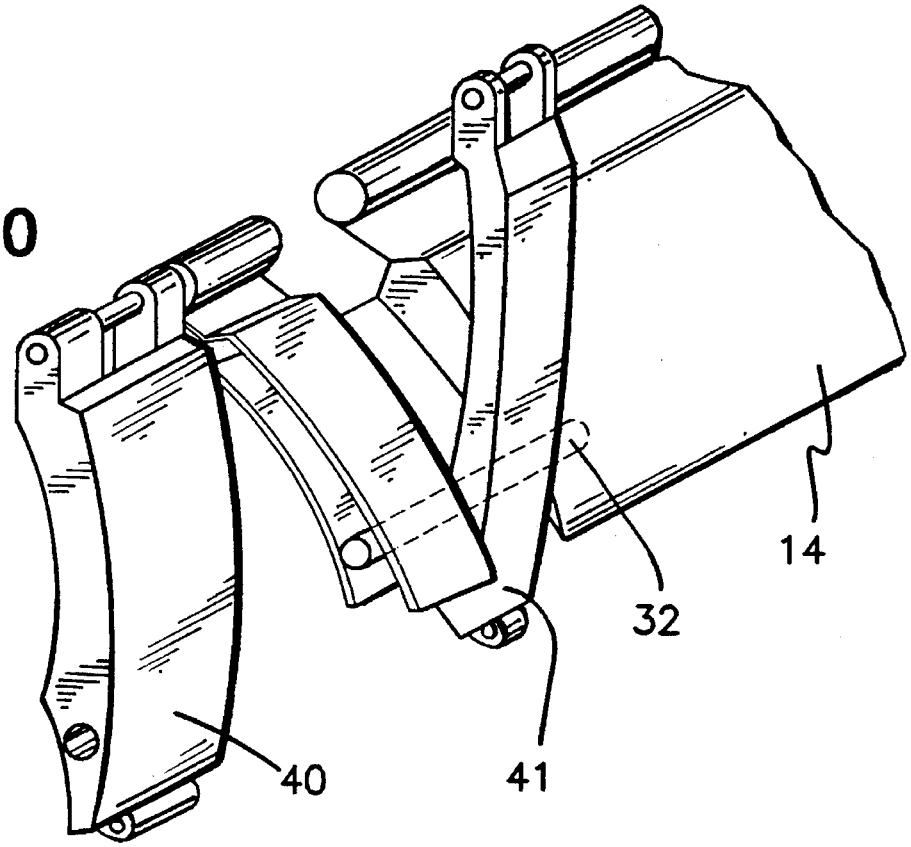

LOUVERABLE ROLLER BLIND

BACKGROUND OF THE INVENTION

1. Field of the Invention.

The invention relates to a roller blind with louverable, lamellar blind slats, which in their upper areas are connected in a hinged manner with elements of a pull chain connected with one another in a hinged manner and in their lower areas with elements of an adjusting chain connected with one another in a hinged manner and are guided laterally in stationary guide profiles, in which the connecting pins of the adjusting chain elements with the blind slats are at a distance from the plane in which the hinge pins of the adjusting chain elements lie.

2. Description of the Related Art.

Such a roller blind is known, for example, from EP-A 382 172. In such roller blinds, it is desirable that, on the one hand, they can be rolled up in the roller housings problem-free and in as space-saving a manner as possible and that, on the other hand, the replacement of non-louverable roller blinds already present in buildings by louverable roller blinds is possible without great changes. In other words, the existing guideways must neither be moved nor replaced by others with larger dimensions. In addition, such roller blinds should consist of as few individual parts as possible and should be able to be produced economically.

The roller blind known from EP-A 382 172 exhibits two disadvantages in this respect. In the first place, it is necessary that the guide profiles must be at a certain distance from the window or door frames or the like, since the blind slats when louvered are not only swiveled outward but also project inward over the guide profiles to a certain extent, which is connected with the special arrangement of the pivot bearings of the blind slats. In the second place, the roller blind according to EP-A 382 172 consists of relatively many individual parts, which has a disadvantageous effect on the production costs.

SUMMARY OF THE INVENTION

The object of the invention is therefore, on the one hand, to make available a roller blind which does not exhibit any parts that can be moved inward, i.e., toward a window or a door or the like, and which, on the other hand, can be produced simply and economically. In this case, the roller blind should be able to be rolled up in the roller housing problem-free and with as small a space requirement as possible.

This object according to the invention is achieved in that the pins of the hinges, by which the pull chain elements and the adjusting chain elements are connected with one another, and the swivel pins of the blind slats in the non-louvered state of the roller blind are aligned with one another.

Because the swivel pins of the blind slats are aligned with the hinge pins of the pull chain elements and the adjusting chain elements and can be moved on the upper edge of the blind slats, the upper area of the blind slats is no longer swiveled inward when the latter are louvered. Another advantage, which is produced by the invention, is that the blind slats can be swiveled by the alignment of the pins in the non-louvered state of the roller blind together with the pull chain elements and adjusting chain elements assigned to them and consequently can be rolled up in the roller housings in a very space-saving manner and problem-free. Another advantage is that a single bearing pin, i.e., a single bearing bolt, can be used for the swivel pins of the blind slats on the pull chain elements and the connecting hinge of two adjacent pull chain elements, by which both the number of components of the roller blind and its production costs can be reduced.

Because the connecting pins of the adjusting chain elements with the blind slats are at a distance from the plane in which the hinge pins of the connecting elements lie, a lever action on the blind slats results, so that the latter can be louvered without problems and additional devices, when the adjusting chain is held or operated by a suitable device.

A preferred embodiment of the invention is characterized in that grooves running crosswise to the longitudinal axis of the blind slats are provided in the louverable blind slats in the area of their ends, in which the adjusting chain elements are essentially completely incorporated in the non-louvered state of the roller blind. Such a groove can be produced in a simple way in the blind slats, e.g., by milling out the corresponding area of the blind slat, and a stable and space-saving accommodation for the pull chain elements is provided.

A possibility according to the invention to guide the roller blind in the stationary guide profiles is characterized in that the blind slats are guided over the pull chain elements in the stationary guide profiles. The blind slats can be simply cut off straight at their ends in this case and the directly adjoining pull chain elements form the guideway in the guide profiles.

Another possibility according to the invention is that the area of the blind slats, in which the swivel pin of the blind slats is incorporated, is extended in the longitudinal direction of the blind slats and that the blind slats are guided by this extension as well as the pull chain elements in the stationary guide profiles. This embodiment offers an even more stable guiding of the blind slats in the guide profiles, since they engage with their extensions directly in the guide profiles.

An especially preferred embodiment of the invention is characterized in that the pull chain elements and/or the adjusting chain elements are produced from extruded profiles. The production of the pull chain and adjusting chain elements from extruded profiles offers the advantage that the outside contour of the pull chain and adjusting chain elements can be matched exactly to the outside shape of the blind slats, so that a continuous, essentially smooth surface of the roller blind is formed without interruptions. The production of the pull chain and adjusting chain elements from extruded profiles in addition offers a significant cost advantage, since extruded profiles can be further processed advantageously and in a simple way.

It can be advantageous in particular in wide roller blinds if at least one center carrying chain is provided, which is designed essentially like the pull chains, so that the blind slats, especially if they are louvered, i.e., swiveled out, do not sag by their own weight, which, on the one hand, is unsightly and, on the other hand, can result in malfunctions.

In this case, the invention can preferably be further developed so that on the side of each blind slat facing away from the outside facade, a number of grooves corresponding to the number of center carrying chains is provided, in which the chain elements of the center carrying chains are essentially completely incorporated. In this case, the center carrying chain is not visible from outside, when the roller blind is closed and furthermore hardly gets in the way when the roller blind is cleaned from inside.

It is especially preferred according to the invention if the pull chain elements, the adjusting chain elements, the center carrying chain elements and/or the blind slats are produced from metallic material, preferably aluminum.

Roller blinds or parts of roller blinds are often produced from plastics. But in the case of sunshade systems, the latter are exposed to very high UV-radiation values as well as atmospheric pollutants, heat and cold, which very greatly reduces the service life of plastic parts. Moreover, metallic materials, with often lower costs, in most cases exhibit higher strength values than plastic parts, and also the tool costs for the production of the parts in the case of plastic in most cases are significantly higher. An extrusion die, for example, costs approximately only 10% of a plastics die. By the simple configuration, according to the invention, of the individual parts of the roller blind, it is possible to produce all parts from metal, preferably from extruded or rolled metal, by which the parts made of plastic encumbered with the mentioned drawback can be replaced.

BRIEF DESCRIPTION OF THE DRAWINGS

Further features and advantages of the invention follow from the description of preferred embodiments of the invention with reference to the drawings, in which FIG. 9 shows a further embodiment of the roller blind according to the invention in a view corresponding to FIG. 4, FIG. 10 is an oblong view sketch, from which the mode of operation of the roller blind according to FIG. 9 can be seen.

DETAILED DESCRIPTION OF THE PREFERRED EMBODIMENTS

Figure 1:
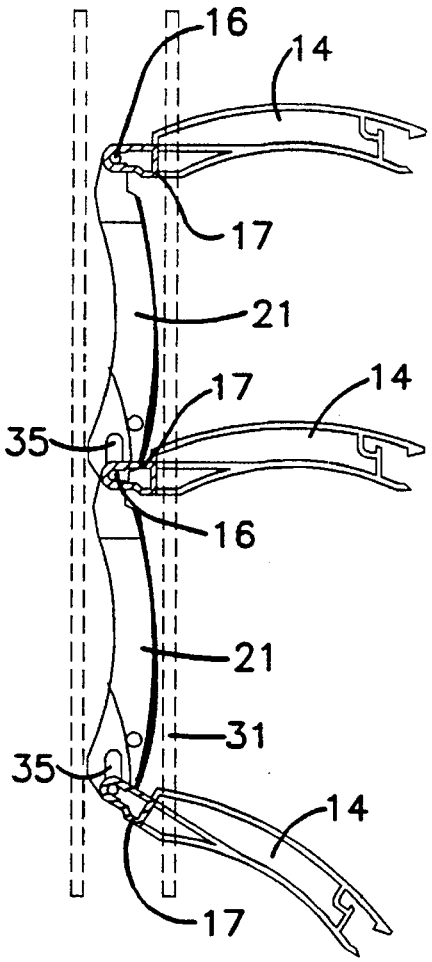
FIG. 1 represents a side view of a roller blind in the louvered state in accordance with arrow I in FIG. 4.
Figure 2:
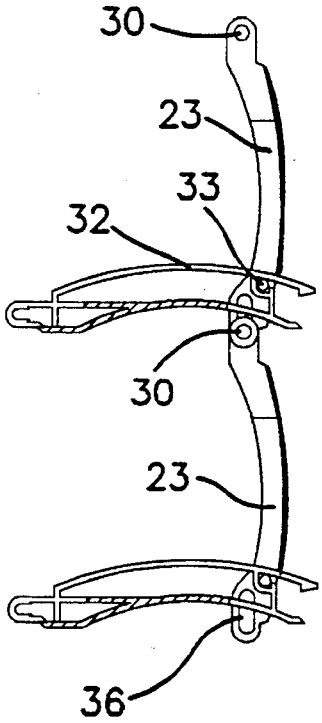
FIG. 2 represents a section through the louvered roller blind in the direction of arrow II in FIG. 4.
Figure 3:
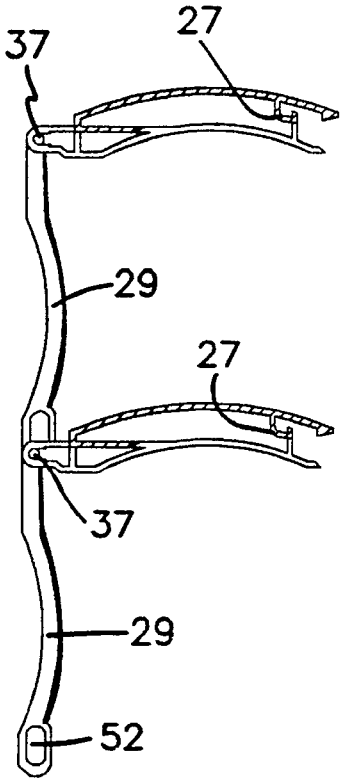
FIG. 3 represents a section through the louvered roller blind in the direction of arrow III in FIG. 4.

With reference to FIGS. 1 to 4, an embodiment of the invention is explained below, and in FIG. 1, only pull chain elements 21 are represented, in FIG. 2, only adjusting chain elements 23, and in FIG. 3, only center carrying chain elements 29 of the roller blind. It is also pointed out that in FIG. 4, drawn-in references I, II and III show how the sections according to FIGS. 1, 2 and 3 are guided, but in FIGS. 1 to 3, the roller blind is shown in the louvered state, and in FIG. 4, the roller blind is shown in the non-louvered, i.e., closed state.

As can be seen from FIG. 1, a pull chain for the roller blind is made from pull chain elements 21, which are connected with one another by pins 16. For this purpose, pull chain elements 21 exhibit a bore on one end and an elongated hole 35 on their other end, whose function will be explained later. Pins 16 simultaneously also form the swivel pins for blind slats 14, which are connected in a hinged manner by pins 16 with pull chain elements 21.

Figure 4:
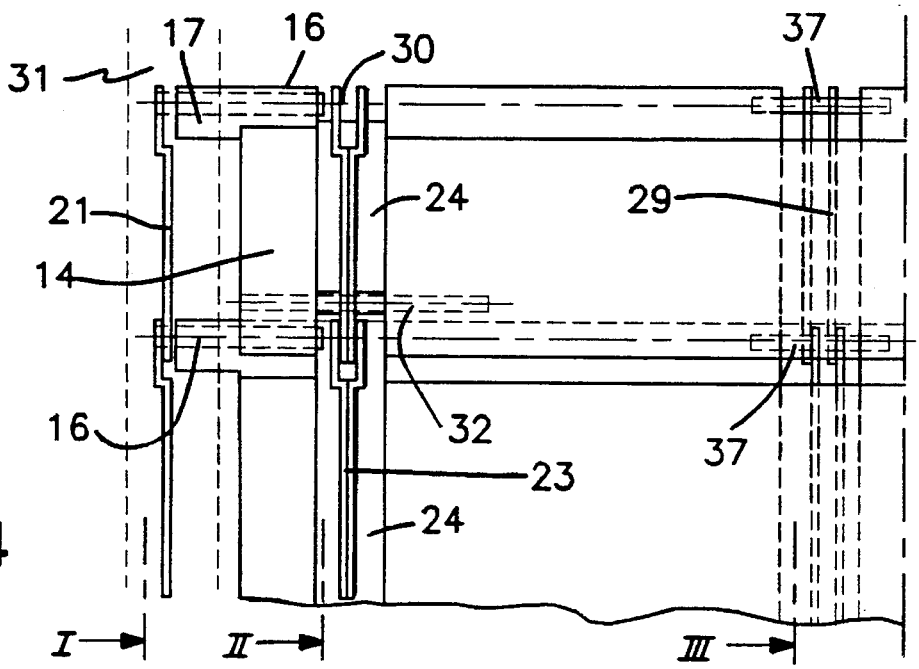
FIG. 4 shows a front view of a part of a roller blind with non-louvered blind slats.

From FIG. 4, it can be seen that blind slats 14 exhibit a part 17 projecting in the area of pin 16 and that this projecting part 17 as well as pull chain elements 21 are guided in a diagrammatically indicated stationary guide profile 31.

Figure 6:
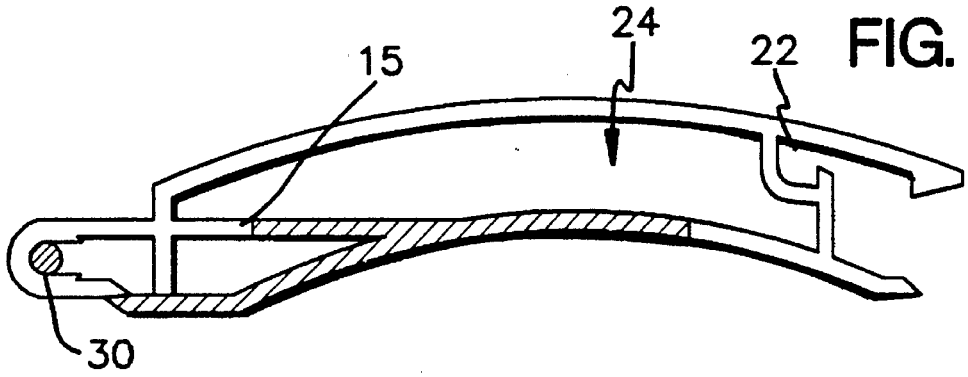

At some distance (for example 20 to 30 mm) from the end of blind slat 14, i.e. from the free end of projecting part 17 and pull chain 21, a groove 24 is provided in blind slat 14, whose course is also represented in FIG. 6. In this groove, adjusting chain elements 23 forming a pull chain are incorporated, which are connected with one another by hinge pins 30. Adjusting chain elements 23 exhibit a bore on one end and an elongated hole 36, as seen in FIG. 2, on the other end just like pull chain elements 21.

Adjusting chain elements 23 in FIG. 2 in addition exhibit a bore 33, which does not lie in the common plane of hinge pins 30 and is at a distance from the latter, preferably 4 to 5 mm. Each adjusting chain element 23 is connected by a connecting pin 32 with a blind slat 14, which is guided through bore 33 in each adjusting chain element 23 and is incorporated in a bore 22, seen only in FIG. 6 or the like in blind slat 14.

If the roller blind exceeds a certain width, one or more center carrying chains can be provided, which are composed of chain elements 29, shown in FIGS. 3 and 4 whose shape corresponds essentially to the shape of pull chain elements 21, with the exception that their width is smaller viewed crosswise to the longitudinal axis of blind slat 14. Blind slats 14 exhibit a groove 53, whose course can be seen only in FIG. 7, on their rear side 25, i.e., the side facing away from the outside facade. Groove 53 and chain elements 29 of FIG. 3 are designed so that chain elements 29 are essentially completely incorporated in groove 53 on rear side 25 of blind slats 14. The same also applies to adjusting chain elements 23 of FIG. 2 on the front side of blind slats 14, so that in the roller blind according to the invention, no parts projecting over the outside contour of blind slats 14 are present, when the roller blind is not louvered.

As can be seen best of all from FIG. 4, pins 16 of pull chain elements 21 as well as hinge pins 30 of adjusting chain elements 23 and pins 37 of center carrying chain elements 29 are aligned when the roller blind is not louvered. This entails a very considerable advantage if the roller blind is wound up on a shaft in the roller housing. Because all above-mentioned pins 16, 30 and 37 are aligned, individual blind slats 14 and corresponding chain elements 21, 23, 29 can be swiveled around a single, common pin, by which, on the one hand, a complete absence of stress of the roller blind is assured and, on the other hand, no swiveling-out parts of blind slats 14 are present, which would increase the winding diameter when the roller blind is wound up.

But because connecting pins 32, shown in FIGS. 2 and 4 by which adjusting chain elements 23 are connected with blind slats 14, do not lie in the common plane of hinge pins 30 of individual adjusting chain elements 23, but are shifted outward, it is assured that blind slats 14 can be louvered without problems and additional auxiliary devices. In particular by pulling on the adjusting chain in an upward direction, or if the adjusting chain is held in place and the roller blind is further lowered, as this is known, for example, from EP-A 382 172, a lever arm is formed between connecting pins 32 and the hinge pins 30 of adjusting chain element 23 on each blind slat 14. Such lever arm assures the swiveling-out of blind slats 14.

As can be seen from FIGS. 1 to 4, chain elements 21, 23 and 29 are produced from plate-shaped parts and, for example, punched out of sheet steel.

Another embodiment of the invention is represented in FIGS. 9 to 14, in which pull chain elements 40, adjusting chain elements 41, and center carrying chain elements 42 are produced from extruded profiles, for example, from aluminum. Blind slats 14 of this embodiment are designed essentially the same as the blind slats 14 of the embodiment according to FIGS. 1 to 4, with one exception, that projection 17, with which blind slats 14 project in stationary guide profiles 31, is not present and blind slats 14 thus exhibit a straight end.

Figure 11:
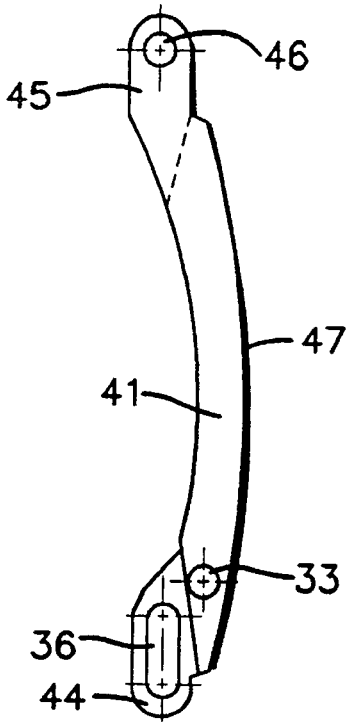
FIG. 11 shows an adjusting chain element of the roller blind according to the invention.
Figure 12:
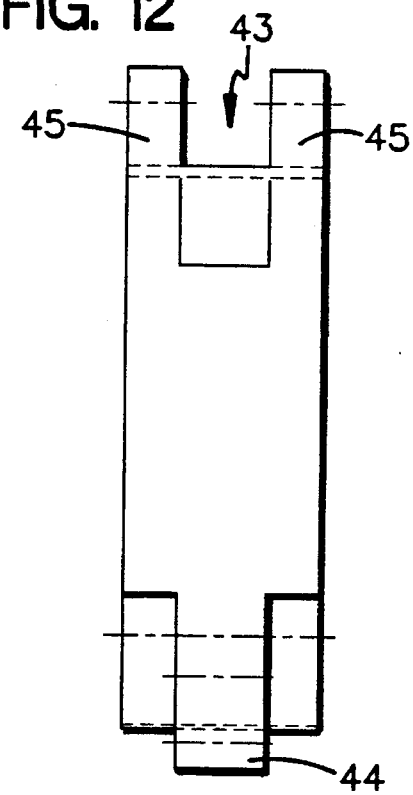
FIG. 12 is a view of the adjusting chain element from the left of FIG. 11.

In FIGS. 11 and 12, an adjusting chain element 41 produced from an extruded profile is represented, which exhibits a forked recess 43 on one side and a projection 44 on the other end. An elongated hole 36 is arranged in projection 44 and bores 46 are provided in flanges 45 limiting forked recess 43. To form an adjusting chain, projection 44 of the adjusting chain element 41 can be moved into forked recess 43 of next adjusting chain element 41 and can be connected with one another by a pin 30, shown in FIG. 9, which penetrates elongated hole 36 and bores 46.

In the area of the lower end of adjusting chain element 41, as seen in FIG. 11, another bore 33 is provided, by which adjusting chain element 41 can be connected in a hinged manner, shown in FIG. 9 with a blind slat 14 by a connecting pin 32.

The production of adjusting chain elements 41 can be performed especially economically, since forked recess 43 or projection 44 of FIG. 12 can be produced by simple milling out of the foundation of adjusting chain element 41.

The cross section shape of adjusting chain element 41 is such that, as seen in FIG. 9, it can be completely incorporated in groove 24 in blind slat 14, and concave side 47 of FIG. 11 showing adjusting chain element 41 is aligned with the concave outside surface of blind slat 14, in which it is incorporated, when the roller blind is not louvered.

Figure 13:
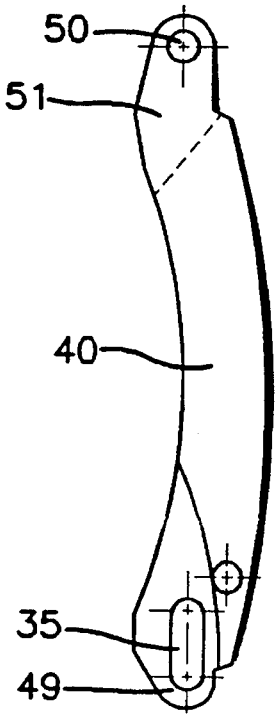
FIG. 13 shows a pull chain element of the roller blind according to the invention.
Figure 14:
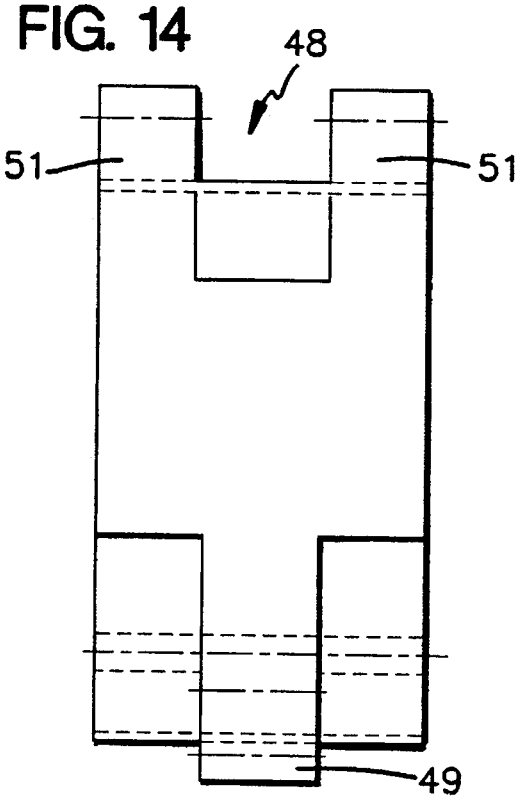
FIG. 14 shows the pull chain element of FIG. 13 in a view from the left of FIG. 13.

Pull chain element 40, which is represented in more detail in FIGS. 13 and 14, is structured corresponding to adjusting chain element 41 of FIGS. 11 and 12, and exhibits a forked recess 48 with bores 50 in flanges 51 as well as a projection 49 with an elongated hole 35. The cross section shape of pull chain element 40 corresponds essentially to the cross section shape of the blind slats 14 of FIG. 9.

Center carrying chain elements 42 are also structured similar to pull chain elements 40 and adjusting chain elements 41, which, however, is not represented in detail in the drawings.

As can be seen from FIG. 9, the roller blind is guided over pull chain elements 40 in the stationary guide profile 31. In addition, it is discernible from FIG. 9 and FIG. 10 that pins 16, 30 and 37 are aligned just like in the embodiment according to FIGS. 1 to 4 with non-louvered blind slats 14, so that the roller blind can be wound up problem-free in the roller housings. The embodiment according to FIGS. 9 to 14 in addition exhibits the advantage that the outside and the inside surface of the roller blind is essentially smooth and continuous, if the roller blind is not louvered, i.e., is closed, which, on the one hand more visually pleasing and, on the other hand, offers advantages in the cleaning of the roller blind.

Figure 5:
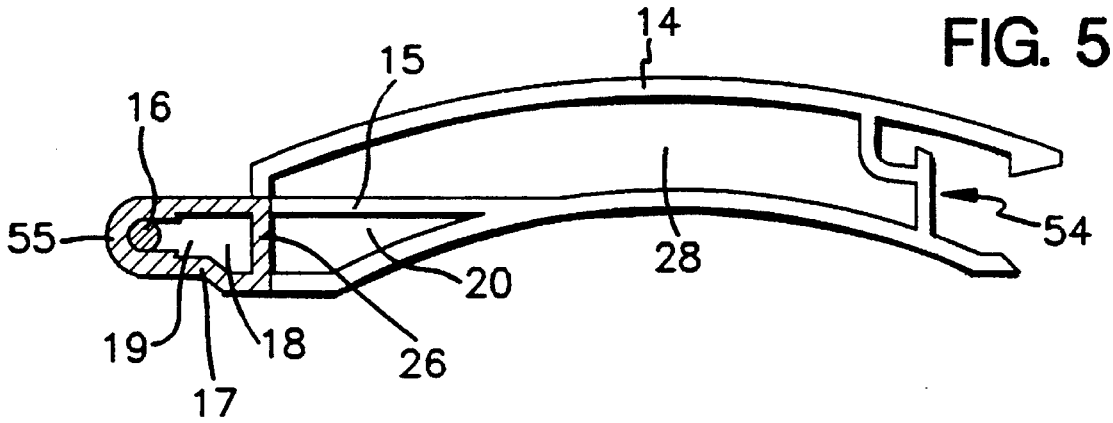
FIGS. 5, 6 and 7 show the cross section of a blind slat along lines I, II and III in FIG. 4.
Figure 7:
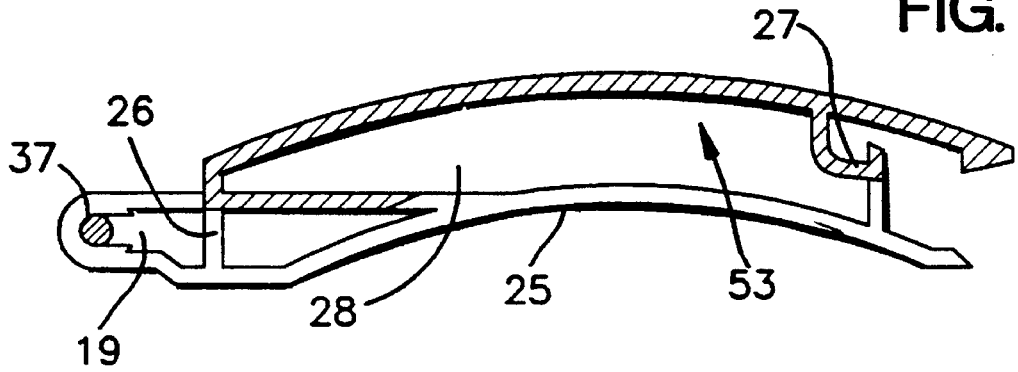

In FIGS. 5 to 7, a profile of a blind slat 14 is represented, which is preferably extruded from aluminum. The profile exhibits three chambers 18, 20 and 28, and a stiffening of the profile is provided by flanges 15, 26 and 27, which is especially advantageous in those areas in which grooves 24 and 53 are provided for either adjusting chain elements 23, 41 or carrying chain elements 29, 42. The profile of blind slat 14 in FIG. 5 in addition exhibits a groove 54 on a longitudinal edge and a spring 55 designed as a catch on the opposite longitudinal edge, in which pin 16 also is incorporated in a recess 19, which are combined as a groove-spring connection when the roller blind is closed and lowered.

In this connection, elongated holes 35, 36 and 52 in the chain elements of FIGS. 13, 11 and 3, respectively are also important, since the latter make it possible for the chains to be telescoped when they are precisely aligned to one another, so that groove-spring connection 54, 55 of FIG. 5 can be brought into its operative position.

Figure 8:
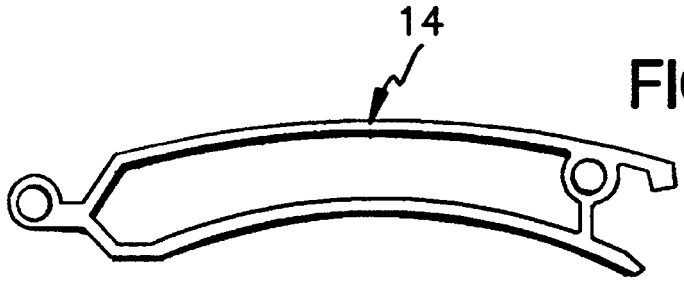
FIG. 8 shows a further embodiment of a blind slat cross section.

In FIG. 8, another embodiment of an extruded profile for blind slats 1 is represented, but which essentially corresponds to the profile according to FIGS. 5 to 7, in which, however, no stiffening ribs are provided.

For pins 16, 30, 32 and 37, of FIGS. 1–4, rivets or pins pressed into the individual components can be used as required. As pin 16, for example, a tubular rivet or a pin provided on one end with a bore and on the other end with a head can be used. The end opposite the head of the rivet or pin can be compressed after the incorporation either in groove 24 (FIG. 4) or inside blind slat 14 (FIG. 9), by which the pin or rivet is axially secured, but is rotatable.

As pin 30, e.g., a smooth pin can be used, and either its ends can be compressed (FIG. 4) or the external openings of bores 46 (FIG. 11) can be compressed after its incorporation. Also, pin 32 in FIGS. 9 and 10 remains rotatable here, but is axially secured.

A smooth pin, e.g., can also be used as pin 37, and in its axial securing, the areas of the bores in addition to pin 37 in FIG. 9 can be compressed from outside by compression molding dies, by which this pin 32 is also secured against axial shifting, but remains rotatable.

Only the left part of a roller blind was represented and described in the description and in the drawings. But the opposite side of the roller blind is designed mirror-image to the represented side and no more than one center carrying chain element 29 or 42, can be provided.

I claim:

1. A louverable roller blind comprising:

stationary guide profiles (31);

pull chain elements (21, 40) connected with one another in a hinged manner via first hinge pins (16);

adjusting chain elements (23, 41) connected with one another in a hinged manner via second hinge pins (30), lying in a plane;

lamellar blind slats (14) guided laterally in the stationary guide profiles, and connected in a hinged manner in their upper areas with the pull chain elements (21, 40) via said first hinge pins and in their lower areas with the adjusting chain elements (23, 41);

pin means (32) for connecting the adjusting chain elements (23, 41) with the lamellar blind slats (14) at the distance from said plane; and whereby the first hinge pins (16) and the second hinge pins (30) are aligned with one another in a nonlouvered state of the roller blind.

2. Roller blind according to claim 1, wherein grooves (24) running crosswise to a longitudinal axis of the blind slats (14) are provided in the blind slats (14) in an area of their ends, in which the adjusting chain elements (23, 41) are essentially completely incorporated in the nonlouvered state of the roller blind.

3. Roller blind according to claim 1, wherein the blind slats (14) are guided over the pull chain elements (40) in the stationary guide profiles (31).

4. Roller blind according to claim 1, wherein an extension area (17) of the blind slats (14), in which the first hinge pins (16) are incorporated, is extended in a longitudinal direction of the blind slats (14) and further wherein the blind slats (14) are guided over this extension area (17) and over the pull chain elements (21) into the stationary guide profiles (31).

5. Roller blind according to claim 1, wherein the pull chain elements (21) and the adjusting chain elements (23) are formed from plate-shaped elements, which are aligned crosswise to the longitudinal direction of the blind slats (14).

6. Roller blind according to claim 1, wherein the pull chain elements (40) and the adjusting chain elements (41) are produced from extruded profiles.

7. Roller blind according to claim 1, wherein at least one center carrying chain element (29, 42) is provided and is designed essentially like the pull chain elements (21, 40).

8. Roller blind according to claim 7, wherein, a side (25) of each blind slat (14) facing away from an outside facade, a number of grooves (53) corresponding to the number center carrying chain elements (29, 42) is provided, in which the chain elements (29, 42) are essentially completely incorporated.

9. Roller blind according to claim 1, wherein one of two hinged lugs of connecting hinges for the pull chain elements (21, 40) and the adjusting chain elements (23, 41) has an elongated hole (35, 36, 52).

10. Roller blind according to claim 9, wherein the blind slats (14) are provided with springs (55) on upper longitudinal edges and with corresponding grooves (54) on lower longitudinal edges.

11. Roller blind according to claim 1, wherein the blind slats (14) exhibit a hollow chamber profile.

12. Roller blind according to claim 7, wherein the pull chain elements (21, 40), the adjusting chain elements (23, 41), the center carrying chain elements (29, 42), and the blind slats (14) are produced from metallic material.

* * * * *